US012268976B2

(12) United States Patent
Kamiyama

(10) Patent No.: US 12,268,976 B2
(45) Date of Patent: Apr. 8, 2025

(54) TOY FOR FIGURE PLAY

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 165 days.

(21) Appl. No.: 17/978,545

(22) Filed: Nov. 1, 2022

(65) Prior Publication Data

US 2023/0140639 A1 May 4, 2023

(30) Foreign Application Priority Data

Nov. 2, 2021 (JP) ..... 2021-179539

(51) Int. Cl.
*A63H 3/52* (2022.01)

(52) U.S. Cl.
CPC ..... *A63H 3/52* (2013.01)

(58) Field of Classification Search
CPC . A63H 3/50; A63H 3/52; A63H 17/25; A63H 33/42; A63H 33/00; A63H 33/30
USPC ..... 446/236, 268, 275, 279, 431, 465, 470
See application file for complete search history.

(56) References Cited

U.S. PATENT DOCUMENTS 1,321,899 A * 11/1919 Dickson ..... A63H 7/04 446/287
1,365,533 A * 1/1921 Nash ..... A63H 33/007 446/449
1,476,199 A * 12/1923 Gazda ..... A63H 7/04 446/281
1,586,870 A * 6/1926 Wetzell ..... A63H 7/04 446/287
1,681,093 A * 8/1928 Capek ..... A63H 7/04 446/277
1,701,243 A * 2/1929 Payne ..... A63H 7/04 446/287
2,016,782 A * 10/1935 Heppner ..... A63H 29/04 446/216
2,641,869 A * 6/1953 Raze ..... A63H 17/40 446/460
2,934,854 A * 5/1960 Comfort, Sr. ..... A63H 7/04 446/286
3,232,003 A * 2/1966 Doe ..... A63H 17/25 446/271

(Continued)

FOREIGN PATENT DOCUMENTS

JP 2525505 Y2 2/1997

*Primary Examiner* — Alexander R Niconovich
(74) *Attorney, Agent, or Firm* — Faegre Drinker Biddle & Reath LLP

(57) ABSTRACT

A toy for figure play includes: a rotating body provided rotatably; and a figure holder provided on the rotating body and configured to hold a figure. The figure holder includes: a seat surface on which a figure is allowed to be placed; a first wall portion erected on a first direction side of the seat surface, the first wall portion including a bulging portion that bulges toward the seat surface; a second wall portion erected on a second direction side of the seat surface so as to face the first wall portion, the second wall portion including a recess portion that corresponds to the bulging portion; and an arm member provided in the first wall portion and provided pivotally on a seat surface side.

7 Claims, 7 Drawing Sheets

(56) References Cited

U.S. PATENT DOCUMENTS 3,238,665 A * 3/1966 Doe ..... A63H 17/25 446/272
3,698,125 A * 10/1972 Hartling ..... A63H 17/25 446/318
3,936,955 A * 2/1976 Gruen ..... G09B 9/048 446/7
4,571,207 A * 2/1986 Henderson ..... A63H 33/30 446/268
4,575,355 A * 3/1986 Lee ..... A63H 17/26 446/484
5,118,320 A * 6/1992 Miller ..... A63H 18/028 446/288
5,890,909 A * 4/1999 Gladish ..... G09B 19/14 280/801.1
6,419,547 B1 * 7/2002 Hartelius ..... B62K 9/00 446/469
6,609,943 B1 * 8/2003 Chan ..... A63H 3/52 446/297
7,942,719 B2 * 5/2011 Leynes ..... B62J 50/40 446/268
7,985,117 B2 * 7/2011 Leynes ..... B62K 3/002 446/268
2006/0270310 A1 * 11/2006 Campbell ..... A63H 33/003 446/268
2006/0270314 A1 * 11/2006 Campbell ..... A63H 17/00 446/268
2006/0270315 A1 * 11/2006 Campbell ..... A63H 33/003 446/268
2006/0270316 A1 * 11/2006 Campbell ..... A63H 33/003 446/268
2006/0270317 A1 * 11/2006 Campbell ..... A63H 17/02 446/268
2006/0270318 A1 * 11/2006 Campbell ..... A63H 33/003 446/268
2006/0270319 A1 * 11/2006 Campbell ..... A63H 33/003 446/268
2012/0270469 A1 * 10/2012 Lourits ..... A63H 17/00 446/268
2024/0139638 A1 * 5/2024 Kamiyama ..... A63H 3/52

* cited by examiner

TOY FOR FIGURE PLAY

CROSS-REFERENCE TO RELATED APPLICATIONS

This application is based on and claims priority under 35 USC 119 from Japanese Patent Application No. 2021-179539 filed on Nov. 2, 2021, the contents of which are incorporated herein by reference.

TECHNICAL FIELD

The present disclosure relates to a toy for figure play which can be played together with a figure by presenting configurations matching various imaginary scenes.

BACKGROUND ART

In the related art, there is a toy for figure play which allows figure play by presenting configurations matching various imaginary scenes. For example, JP2525505Y2 discloses a merry-go-round baby carriage as a toy for figure play including a seat frame configured to rotate as the baby carriage travels and hold a figure thereon.

SUMMARY OF INVENTION

A child who is a user plays using a plurality of types of figures. As a result, the related-art toy for figure play may hardly handle figures of different sizes. For example, when a small figure is placed on the seat frame, the figure may fall off from the seat frame, and the figure play may become uninteresting.

An object of the present disclosure is to provide a toy for figure play which can be played with fun even a plurality of types of figures having different shapes and sizes are used.

The present disclosure provides a toy for figure play including: a rotating body provided rotatably; and a figure holder provided on the rotating body and configured to hold a figure, wherein the figure holder includes: a seat surface on which a figure is allowed to be placed; a first wall portion erected on a first direction side of the seat surface, the first wall portion including a bulging portion that bulges toward the seat surface; a second wall portion erected on a second direction side of the seat surface so as to face the first wall portion, the second wall portion including a recess portion that corresponds to the bulging portion; and an arm member provided in the first wall portion and provided pivotally on a seat surface side.

According to the present disclosure, a toy for figure play can be provided which can be played with fun even a plurality of types of figures having different shapes and sizes are used.

BRIEF DESCRIPTION OF DRAWINGS

FIG. 7A shows a state in which a medium-sized figure to be played with the toy for figure play is held, FIG. 7B shows a state in which a large-sized figure is held, and FIG. 7C shows a state in which a small-sized figure is held.

DESCRIPTION OF EMBODIMENTS

Figure 1:
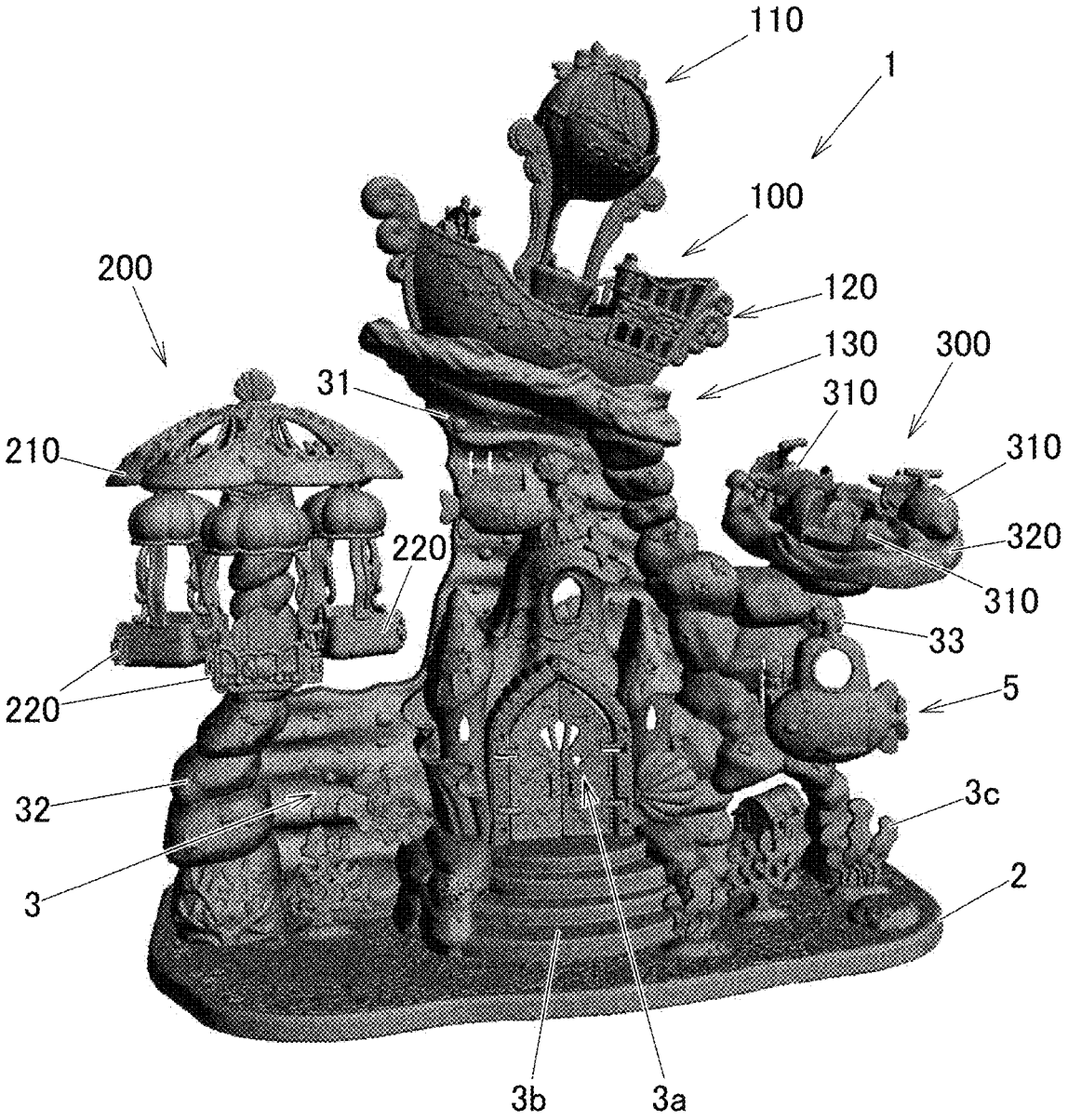
FIG. 1 is an overall perspective view of a toy for figure play according to an embodiment of the present disclosure.

An embodiment of the present disclosure will be described with reference to the drawings. FIG. 1 is a view showing a toy for figure play 1 imitating an undersea castle as viewed from front. The toy for figure play 1 includes a figure toy main body 5 including a plate-shaped base portion 2 to be placed on a floor or the like and a support main body portion 3 provided on the base portion 2. The support main body portion 3 includes a central support plate 31 formed to be high, and a first playing portion 100 serving as a playing portion is provided on a top of the central support plate 31. The first playing portion 100 is detachably provided with a ship 120 including a balloon portion 110. In the support main body portion 3 below the first playing portion 100, a door 3*a* and stairs 3*b* imitating those of the castle, and seaweed 3*c* at predetermined positions are provided. In the toy for figure play 1, a part below a corrugated wave portion 130 at a central top portion of the support main body portion 3 on which the ship 120 is placed imitates a castle on a seabed. The toy for figure play 1 is set to be played with a figure whose height is smaller than a height of the door 3*a*, for example, about two-thirds of the height of the door 3*a*.

As seen in FIG. 1, a second playing portion 200 is provided on an upper portion of a support post 32 on a left side of the support main body portion 3, and a third playing portion 300 is provided on an upper portion of a branch-shaped support portion 33 extending in a branch shape on a right side of the support main body portion 3. The second playing portion 200 includes a rotating body 210 and three suspension bodies 220 which are suspended from the rotating body 210 and on which figures can be placed. The rotating body 210 is a playing portion that can be manually rotated and enjoyed by swinging the suspension bodies 220 on which the figures are placed. The third playing portion 300 is a playing portion in which a merry-go-round play can be enjoyed by manually rotating a substantially disk-shaped rotating body 320 provided with three figure holders 310 in forms of a crab, a dolphin, and a fish.

Next, the figure holder 310 of the third playing portion 300 which is a main part of the present disclosure will be described in detail with reference to FIGS. 2 to 6. Three figure holders 310 are provided on the rotating body 320, and the figure holder 310 having a dolphin shape will be described below as an example.

Figure 2:
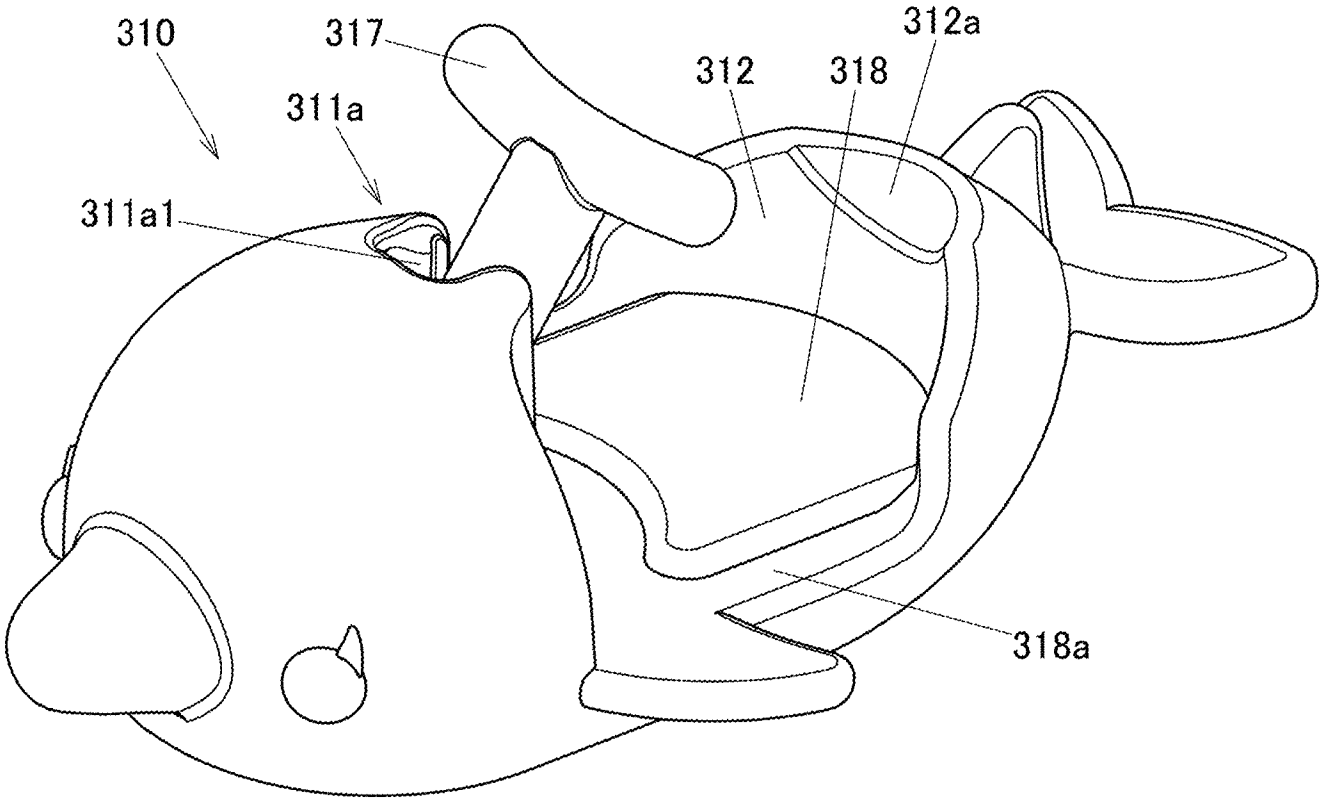
FIG. 2 is a perspective view of a figure holder of the toy for figure play according to the embodiment of the present disclosure as viewed from front.
Figure 3:
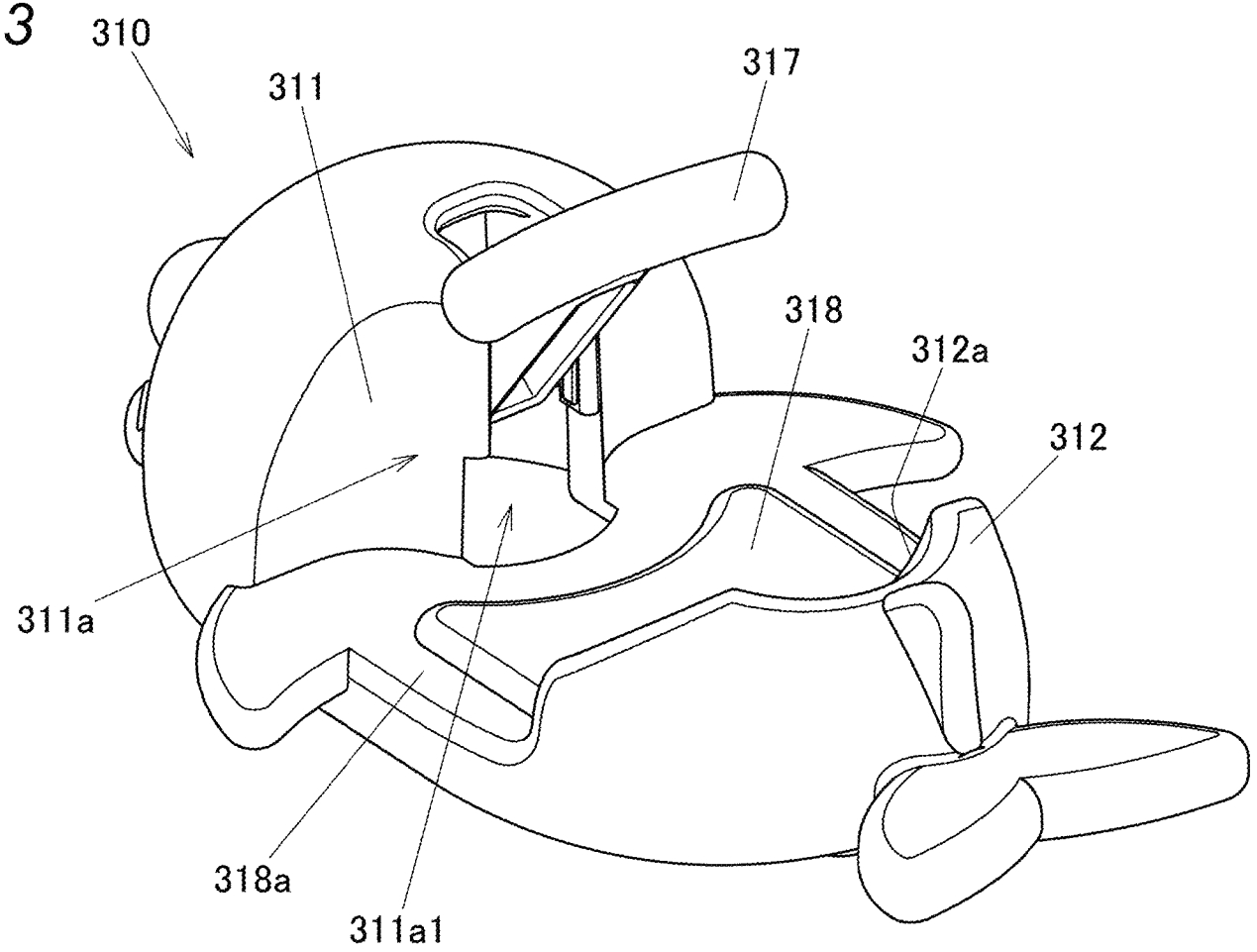
FIG. 3 is a perspective view of the figure holder of the toy for figure play according to the embodiment of the present disclosure as viewed from rear.

As shown in FIGS. 2 and 3, the figure holder 310 includes a seat surface 318 which is formed in a flat surface shape in order to place a figure thereon. The seat surface 318 is formed to be slightly higher than a floor surface 318*a*. Thus, it is easy for a child who is a user to recognize that the seat surface 318 is a place where the figure is to be placed. On a dolphin head side (hereinafter also referred to as "front side") which is a first direction side of the seat surface 318, a first wall portion 311 is erected so as to have a wall surface substantially perpendicular to the seat surface 318. In other words, the first wall portion 311 is provided on a back surface side (hereinafter also referred to as "rear side") of a dolphin head.

A bulging portion 311*a* bulging toward the seat surface 318 is provided at a substantially central portion (a substantially central portion in a left-right direction when a figure is seated on the seat surface 318) of the first wall portion 311. The bulging portion 311*a* is formed from an upper end to a lower end of the first wall portion 311. An opening portion 311*a*1 which extends from an upper surface of the dolphin head to a lower end of the first wall portion 311, and which is opened in the bulging portion 311*a* is formed in the bulging portion 311*a*. An arm member 317 is provided in the opening portion 311*a*1.

Figure 4:
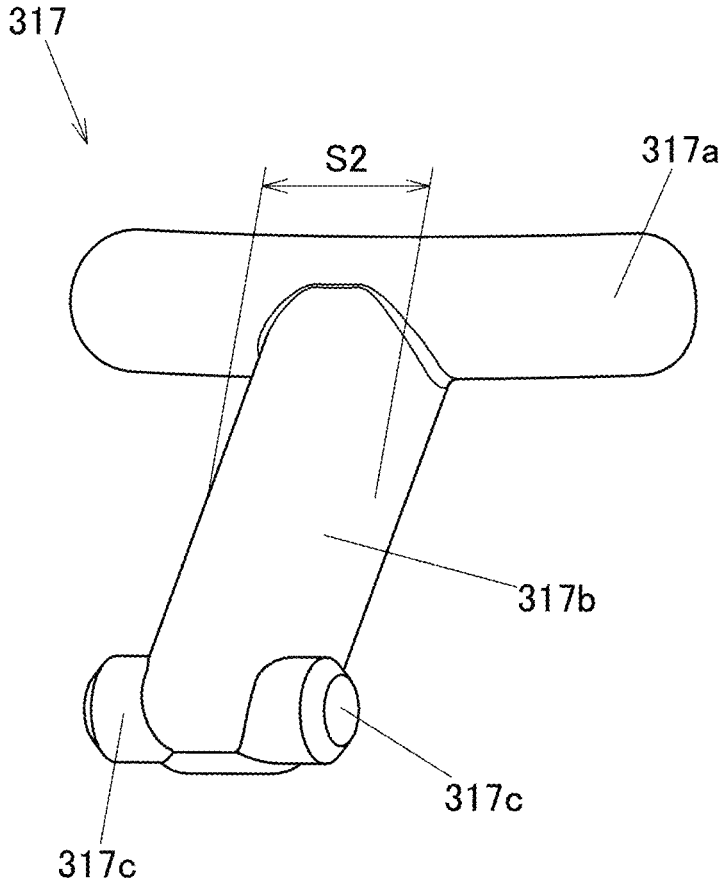
FIG. 4 is a perspective view of an arm member of the toy for figure play according to the embodiment of the present disclosure.

As shown in FIG. 4, the arm member 317 is formed in a substantially T shape. The arm member 317 includes an abutting bar 317*a* corresponding to a horizontal bar part of the T shape and a rotating bar 317*b* corresponding to a vertical bar part of the T shape. The abutting bar 317*a* extending in the left-right direction is formed to be slightly curved. At a tip end portion of the rotating bar 317*b*, two cylindrical rotating shafts 317*c* protruding in the left-right direction are provided facing each other.

Figure 6:
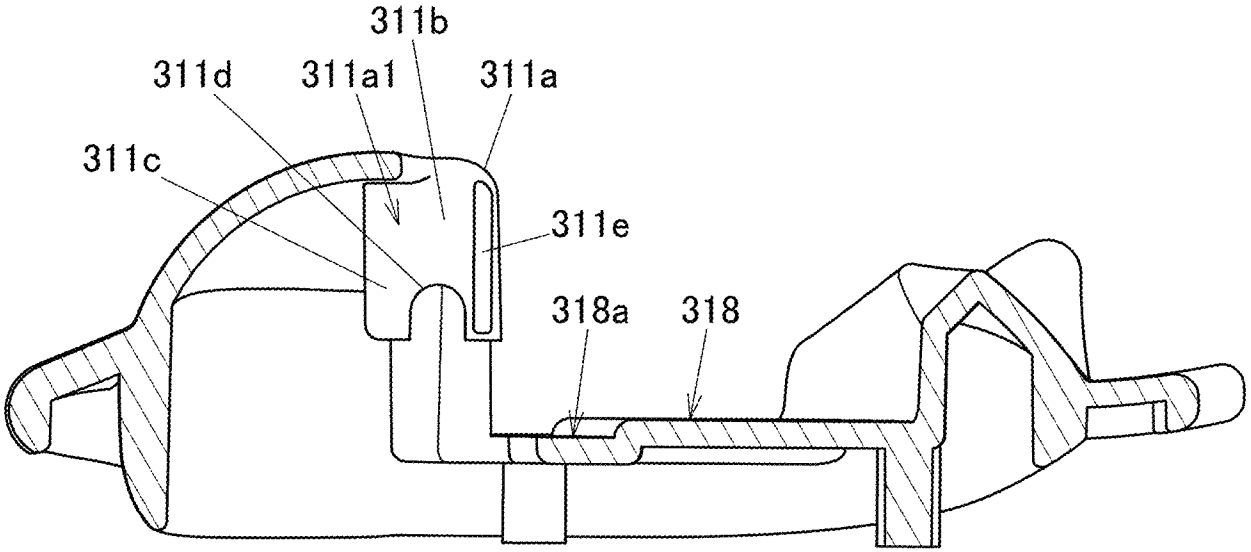
FIG. 6 is a cross-sectional view of the figure holder taken along a line IV-IV in FIG. 5, in which the arm member of the toy for figure play according to the embodiment of the present disclosure is omitted.

As shown in FIG. 6, support plates 311*c* extending from an upper end of the opening portion 311*a*1 downward to a substantially intermediate position in an upper-lower direction of the opening portion 311*a*1 are provided on both sides (both left and right sides of the seat surface 318 when a figure is seated) of the opening portion 311*a*1 of the bulging portion 311*a*. At a lower end of the support plate 311*c*, a shaft support portion 311*d* having a rectangular shape with rounded corners, which is long in the upper-lower direction and has a semicircular shape on an upper side, is provided. The shaft support portions 311*d* rotatably support the rotating shafts 317*c* of the arm member 317.

Figure 5:
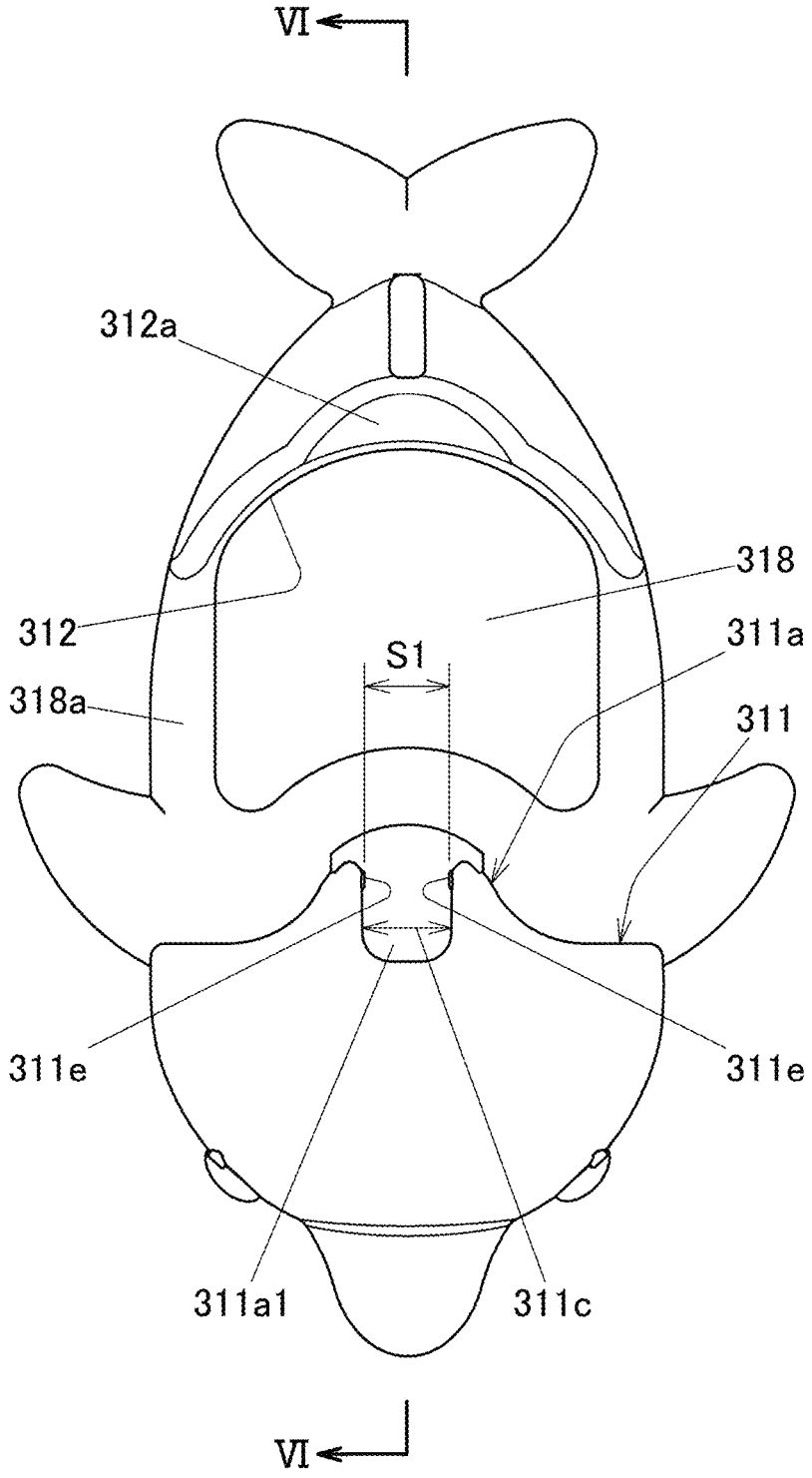
FIG. 5 is a top view of the figure holder in which the arm member is omitted in the toy for figure play according to the embodiment of the present disclosure.

Further, as shown in FIGS. 5 and 6, a sliding resistance portion 311*e* protruding in a substantially rectangular shape which is long in the upper-lower direction is provided on a seat surface 318 side of the support plate 311*c*. The sliding resistance portions 311*e* are provided at the two support plates 311*c* so as to face each other. A distance S1 between the facing sliding resistance portions 311*e* is set to be slightly smaller than a width S2 of the rotating bar 317*b* of the arm member 317 shown in FIG. 4. Therefore, the arm member 317 pivots such that side surfaces of the rotating bar 317*b* slide relative to the sliding resistance portions 311*e* while being in pressure contact therewith. Therefore, the arm member 317 is pivoted toward the seat surface 318 side while receiving predetermined resistance from the sliding resistance portions 311*e*.

With reference to FIGS. 2 and 3 again, a second wall portion 312 erected on a second direction side of the seat surface 318 is provided on the figure holder 310. Here, the second direction side is a side different from the first direction side, and is an opposite side with respect to the first direction side in the present embodiment. The second wall portion 312 faces the first wall portion 311 and is formed in a recessed curved surface shape on the seat surface 318 side. In the second wall portion 312, a concave spherical recess portion 312*a* is formed from an upper surface of the second wall portion 312 to a surface on the seat surface 318 side. The recess portion 312*a* corresponds to the bulging portion 311*a* of the first wall portion 311 and is provided at a substantially central portion (a substantially central portion in the left-right direction when a figure is seated on the seat surface 318).

The figure holder 310 is opened on lateral sides of the seat surface 318 (that is, between the first wall portion 311 and the second wall portion 312), and a figure can be placed easily. Further, the first wall portion 311 and the second wall portion 312 are disposed in a front-rear direction of the figure holder 310 along a rotation direction of the rotating body 320 (a rotation direction around a center of the rotating body 320 in FIG. 1)

Figure 7A:
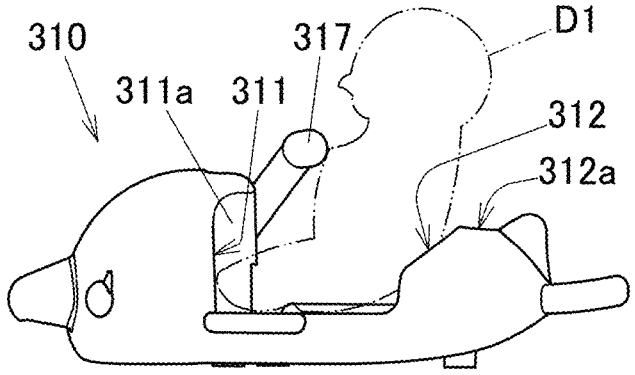
FIGS. 7A to 7C are side views showing states in which figures of various sizes are held in the figure holder of the toy for figure play according to the embodiment of the present disclosure.
Figure 7B:
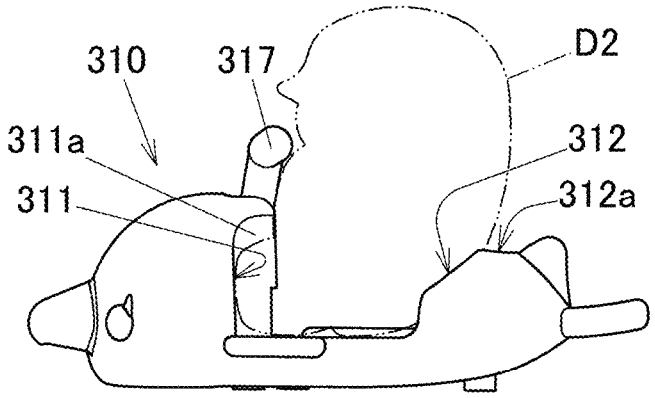
Figure 7C:
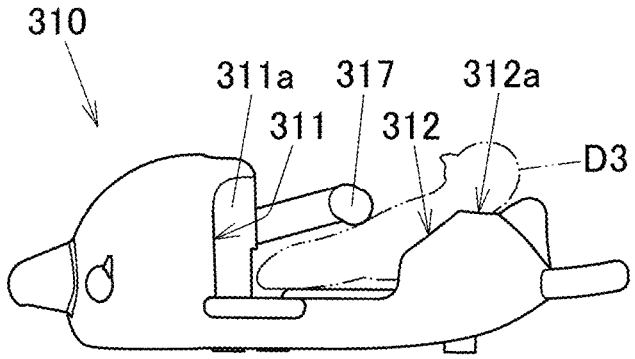

As shown in FIGS. 7A to 7C, the figure holder 310 can hold figures of various shapes and sizes. For example, in FIG. 7A, a figure D1 which is an anthropomorphic animal abuts the first wall portion 311 with leg portions thereof and abuts the second wall portion 312 with a back thereof. Then, the arm member 317 is pivoted and abutted with a region from a chest to an abdomen of the figure D1. The abutting bar 317*a* of the curved arm member 317 allows the abdomen or chest of the figure D1, which normally has a substantially circular cross-section, to suitably abut and press the figure D1. According to a form of the figure D1, the bulging portion 311*a* can be pressed between the leg portions of the figure D1. In this way, the figure D1 can be held such that the figure D1 does not fall off from the figure holder 310.

Further, in FIG. 7B, a large-sized figure D2 is held by the figure holder 310. In a case of the figure D2, the figure D2 can be held in a manner of being sandwiched between the bulging portion 311*a* and the second wall portion 312 by pulling up the arm member 317 to cause the bulging portion 311*a* to abut between leg portions of the figure D2 and a back of the figure D2 to abut with the second wall 312.

Further, in FIG. 7C, the small-sized figure D3 is held by the figure holder 310. In a case of the figure D3, even if leg portions of the figure D3 do not reach the first wall portion 311 or the bulging portion 311*a*, the figure D3 can be held by abutting a head of the figure D3 with the recess portion 312*a* of the second wall portion 312 and pressing the arm member 317 around an abdomen of the figure D3.

According to the embodiment of the present disclosure as described above, it is possible to provide a toy for figure play of the following aspects.

A toy for figure play according to a first aspect includes: a rotating body provided rotatably; and a figure holder provided on the rotating body and configured to hold a figure, and the figure holder includes: a seat surface on which a figure is allowed to be placed; a first wall portion erected on a first direction side of the seat surface, the first wall portion including a bulging portion that bulges toward the seat surface; a second wall portion erected on a second direction side of the seat surface so as to face the first wall portion, the second wall portion including a recess portion that corresponds to the bulging portion; and an arm member provided in the first wall portion and provided pivotally on a seat surface side.

According to the configuration, since figures of various shapes and sizes can be reliably held, the figure does not fall off from the rotating body, thus providing a toy for figure play including a playing portion such as a merry-go-round. In particular, in a case of a figure which is an anthropomorphic animal, since the figures have different shapes for various animal motifs, even when a wide variety of figures such as figures in a small baby state to grown-up state are used, the figures can be played without falling off from the figure holder.

In the toy for figure play according to a second aspect, the first wall portion and the second wall portion are provided along a rotation direction of the rotating body.

According to the configuration, the figure can be placed on the seat surface with the first wall portion on a front side and the second wall portion on a rear side, thus providing a toy for figure play including a playing portion such as a merry-go-round.

In the toy for figure play according to a third aspect, the arm member is formed in a T shape.

According to the configuration, depending on a shape of the figure, a horizontal bar part of the T shape can be abutted with an abdomen or a chest, so that the figure can be held more reliably.

In the toy for figure play according to a fourth aspect, the arm member is provided in an opening portion formed in the bulging portion.

According to the configuration, it is possible to hold the figure while providing a larger area of the seat surface.

In the toy for figure play according to a fifth aspect, a sliding resistance portion is provided in the opening portion, the slide resistance portion being configured to slidably contact the arm member to apply a resistance force against a pivotal movement of the arm member.

According to the configuration, the resistance force is applied against the pivotal movement of the arm member, whereby the figure can be securely held.

In the toy for figure play according to a sixth aspect, the figure holder is opened between the first wall portion and the second wall portion.

According to the configuration, the figure can be placed on the figure holder easily.

Although the embodiment of the present disclosure have been described above, the present disclosure is not limited to the above-described embodiment, and various modifications can be made without departing from the scope of the present invention. For example, three figure holders 310 are provided on the rotating body 310, but it is sufficient that one or more figure holders 310 are provided.

What is claimed is:

1. A toy for figure play comprising:

a rotating body; and a figure holder provided on the rotating body and configured to hold a figure, wherein the figure holder comprises:

a seat surface on which a figure is allowed to be placed;

a first wall portion erected on a first direction side of the seat surface, the first wall portion including a bulging portion that bulges toward the seat surface;

a second wall portion erected on a second direction side of the seat surface so as to face the first wall portion, the second wall portion including a recess portion that corresponds to the bulging portion; and an arm member provided in the first wall portion and provided pivotally on a seat surface side, wherein the arm member is pivotable around an axis extending along the seat surface and the first wall portion.

2. The toy for figure play according to claim 1, wherein the first wall portion and the second wall portion are provided along a rotation direction of the rotating body.

3. The toy for figure play according to claim 1, wherein the arm member is formed in a T shape.

4. The toy for figure play according to claim 1, wherein the arm member is provided in an opening portion formed in the bulging portion.

5. The toy for figure play according to claim 4, wherein a sliding resistance portion is provided in the opening portion, the slide resistance portion being configured to slidably contact the arm member to apply a resistance force against a pivotal movement of the arm member.

6. The toy for figure play according to claim 1, wherein the figure holder is opened between the first wall portion and the second wall portion.

7. The toy for figure play according to claim 1, wherein the rotating body is a disk-shaped rotating body that rotates in a rotation direction around a center of the rotating body.

* * * * *